US007152358B1

(12) United States Patent
LeAnna et al.

(10) Patent No.: US 7,152,358 B1
(45) Date of Patent: Dec. 26, 2006

(54) MULTI-ADJUSTABLE PORTABLE SHOOTING BENCH

(75) Inventors: David LeAnna, Nashville, TN (US); Shane LeAnna, Nashville, TN (US)

(73) Assignee: Do-All Traps, LLC, Nashville, TN (US)

( * ) Notice: Subject to any disclaimer, the term of this patent is extended or adjusted under 35 U.S.C. 154(b) by 0 days.

(21) Appl. No.: 10/981,299

(22) Filed: Nov. 4, 2004

Related U.S. Application Data

(60) Provisional application No. 60/600,712, filed on Aug. 10, 2004.

(51) Int. Cl.
*F41A 31/00* (2006.01)

(52) U.S. Cl. ..... 42/94; 89/37.04; 297/170

(58) Field of Classification Search ..... 42/94; 89/37.04; 297/172, 156, 170, 174 R
See application file for complete search history.

(56) References Cited

U.S. PATENT DOCUMENTS

| | | | | |
|---|---|---|---|---|
| 4,501,082 | A | 2/1985 | Phillips | |
| 4,563,829 | A | 1/1986 | Bozick | |
| 4,565,403 | A | 1/1986 | Brown | |
| 4,937,965 | A | 7/1990 | Narvaez | |
| 5,149,900 | A * | 9/1992 | Buck | 42/94 |
| 5,271,175 | A | 12/1993 | West, III | |
| 5,284,280 | A | 2/1994 | Stonebraker, Sr. | |
| 5,414,949 | A | 5/1995 | Peebles | |
| 5,491,921 | A | 2/1996 | Allen | |
| 5,778,589 | A * | 7/1998 | Teague | 42/94 |
| 5,833,308 | A * | 11/1998 | Strong et al. | 297/172 |
| 5,884,966 | A * | 3/1999 | Hill et al. | 297/170 |
| 6,044,747 | A * | 4/2000 | Felts | 89/40.06 |
| 6,058,641 | A | 5/2000 | Vecqueray | |
| 6,269,578 | B1 * | 8/2001 | Callegari | 42/94 |
| 6,871,440 | B1 * | 3/2005 | Highfill et al. | 42/94 |
| 6,895,709 | B1 * | 5/2005 | Krien et al. | 42/94 |
| 6,935,064 | B1 * | 8/2005 | Thompson | 42/94 |

OTHER PUBLICATIONS

CABELA'S Magnum Shooting Bench, Jan. 5, 2004 at www.cabelas.com.
CABELA'S HardKore Precision Shooting DeVICE and System, Jan. 5, 2004 at www.cabelas.com.
CABELA'S Outdoor Exrtreme Buck Bench, Jan. 5, 2004 at www.cabelas.com.
CABELA'S Elite Shooting Bench, Jan. 5, 2004 at www.cabelas.com.
CABELA'S Big Game Shooting Bench, Jan. 5, 2004 at www.cabelas.com.

* cited by examiner

*Primary Examiner*—J. Woodrow Eldred
(74) *Attorney, Agent, or Firm*—Miller & Martin PLLC

(57) ABSTRACT

An adjustable portable shooting bench is built about a length adjustable longitudinal structural member with front and rear supports, a rear seat, a forward pivot axis mount on which are rotatably and adjustably mounted radially extending supports carrying an elbow tray and a muzzle rest tray.

19 Claims, 16 Drawing Sheets

MULTI-ADJUSTABLE PORTABLE SHOOTING BENCH

The present application claims priority to the Aug. 10, 2004 filing date of U.S. provisional patent application Ser. No. 60/600,712.

FIELD OF THE INVENTION

The present invention relates to a weapon benchrest and in particular, a fully adjustable benchrest including a seat for the shooter.

BACKGROUND OF THE INVENTION

When shooting for accuracy, marksmen are invariably able to improve their results by utilizing a stabilizing rest or mount for their weapon. Accordingly, the use of shooting benches has become popular. In its simplest form, a shooting bench may be nothing more than a table and chair combined with either a gun mount or sandbag upon which the firearm may be rested in a stable fashion. Because target shooting is often practiced in locations remote from populated and traveled areas, it is also desirable that weapon benchrests used for this purpose be portable and easy to assemble. Thus, a weapon benchrest may consist principally of a folding table and folding chair for portability. However, as shooting benches and weapon benchrests have evolved, improvements have been made such as creating combination table-chair folding devices, providing swiveling seats, providing recoil absorption, and providing micro adjusting capabilities.

SUMMARY OF THE INVENTION

An object of this invention is to provide a fully adjustable portable shooting bench that can be easily assembled and disassembled.

Another object of this invention is to provide a shooting bench adjustable to fit a wide range of shooting styles for both left and right handed marksmen, and for wheelchair bound marksmen.

A further object of this invention is to provide a shooting bench that can be used freestanding or mounted to a trailer hitch.

A still further object of this invention is to provide a shooting bench with a gear tray to hold ammunition and tools.

In keeping with these objects, and others which will become apparent hereinafter, one embodiment of this invention is disclosed in an apparatus that has a seat, mounting hitch, rear legs, a front foot, and a plurality of swivel connected members supporting a gear table, elbow table and muzzle table.

The novel features which are considered as characteristic of the invention are set forth in particular in the appended claims. The invention itself, both as to its construction and its method of operation, together with additional objects and advantages thereof, will be best understood from the following description of specific embodiments when read in connection with the accompanying drawings.

DETAILED DESCRIPTION OF THE INVENTION

Figure 1:
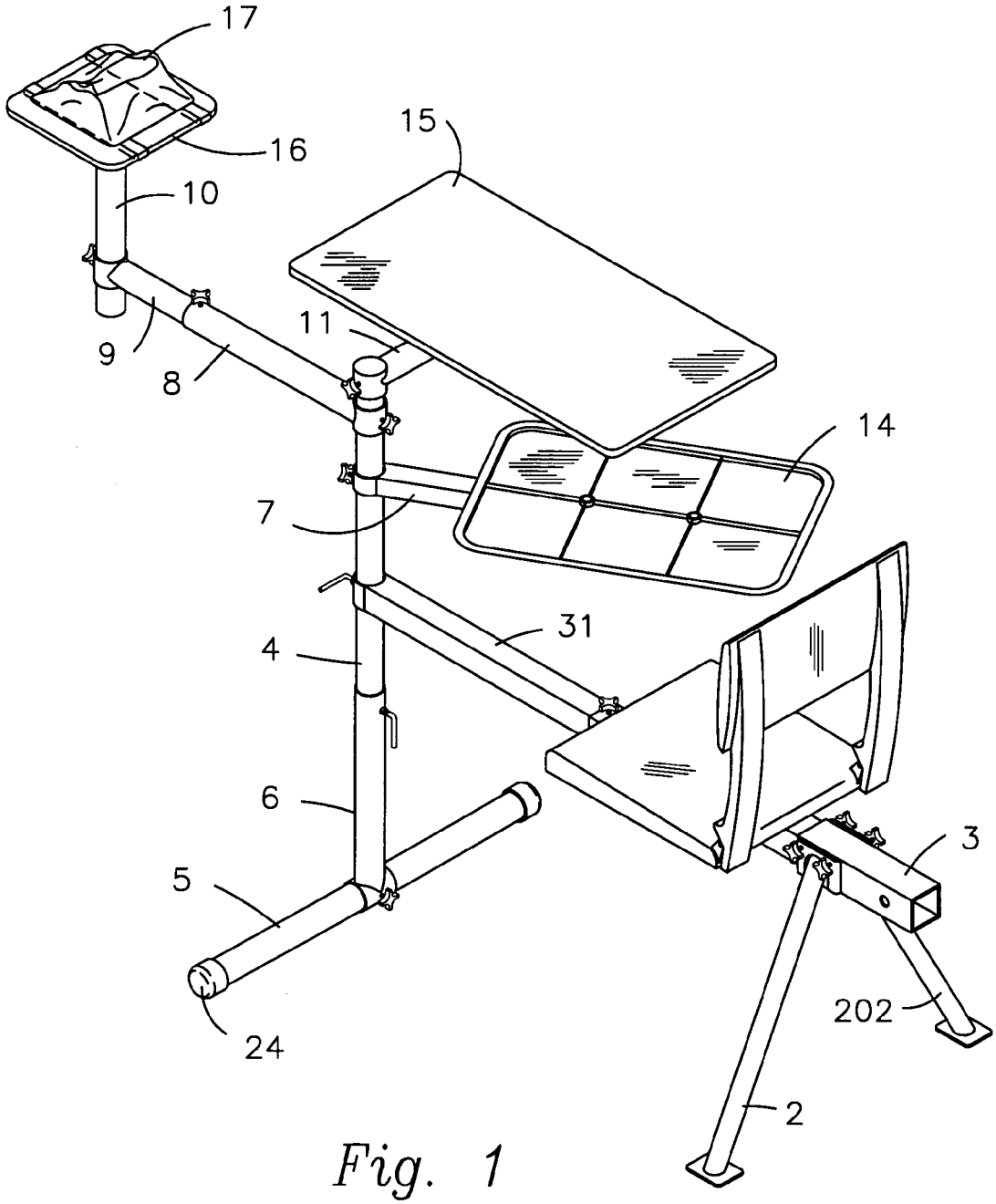
FIG. 1 is a perspective view of an assembled shooting bench according to the present invention.

Turning then to FIG. 1, a preferred embodiment of the adjustable portable shooting bench according to the present invention is depicted. The bench is constructed about a longitudinal structural member such as beam 3 with a seat 12 comprised of seat bottom 120 and seat back 121 mounted towards a first end of beam 3. One form of rear support is a hitch mount 1 is at the terminus of this first end. An alternate support structure, and preferably rear legs such as angled members 2, 202 provide support for seat 12 if the hitch mount 1 is not in use. At the second end of beam 3 is the front support structure, in this embodiment comprising front foot 5 and lower portion 6 of front leg 2. An upper portion 4 of front leg 2 extends above beam 3 and serves as the pivot axis mount for swivel connections with radially extending gear tray support member 7, muzzle table horizontal support member 8 and elbow table support such as swivel connector 11. Gear tray 14 is mounted to the gear tray support member such as bar 7. The elbow table 15 fits upon an end of swivel connector 11. Horizontal support 8 for muzzle tray preferably has a second horizontal component 9 adjustable with respect to horizontal member 8 to allow the muzzle table 16 to be adjusted an appropriate distance from front leg tube 4. At the end of the second horizontal support member 9 is a vertical muzzle tray support tube 10 which permits the height of muzzle table 16 to be adjusted. A suitable muzzle rest such as sandbag 17 is placed on muzzle table 16. Each of the horizontal members 7, 8, 11 are adjustable along front leg tube 4 with respect to the height of the member. In addition, the angle at which member extends radially from front leg tube 4 is adjustable so that the gear tray 14, elbow table 15 and muzzle table 16 are adjustable to a wide range of orientations from the front leg tube 4 and over a substantial range of heights with respect to seat 12. Preferably each of the horizontal members 7, 8, 11 may be oriented through a full range of 360° of orientation with respect to the pivot axis mount, however, very acceptable results are achieved by permitting only a range of about 270° of orientation in forward directions generally opposite the rearward direction of the seat 12. The lengths of gear tray support member 7 and elbow table swivel connector 11 may also be adjustable if an alternate structure, such as that used for the muzzle table support members 8, 9 is employed.

Figure 2:
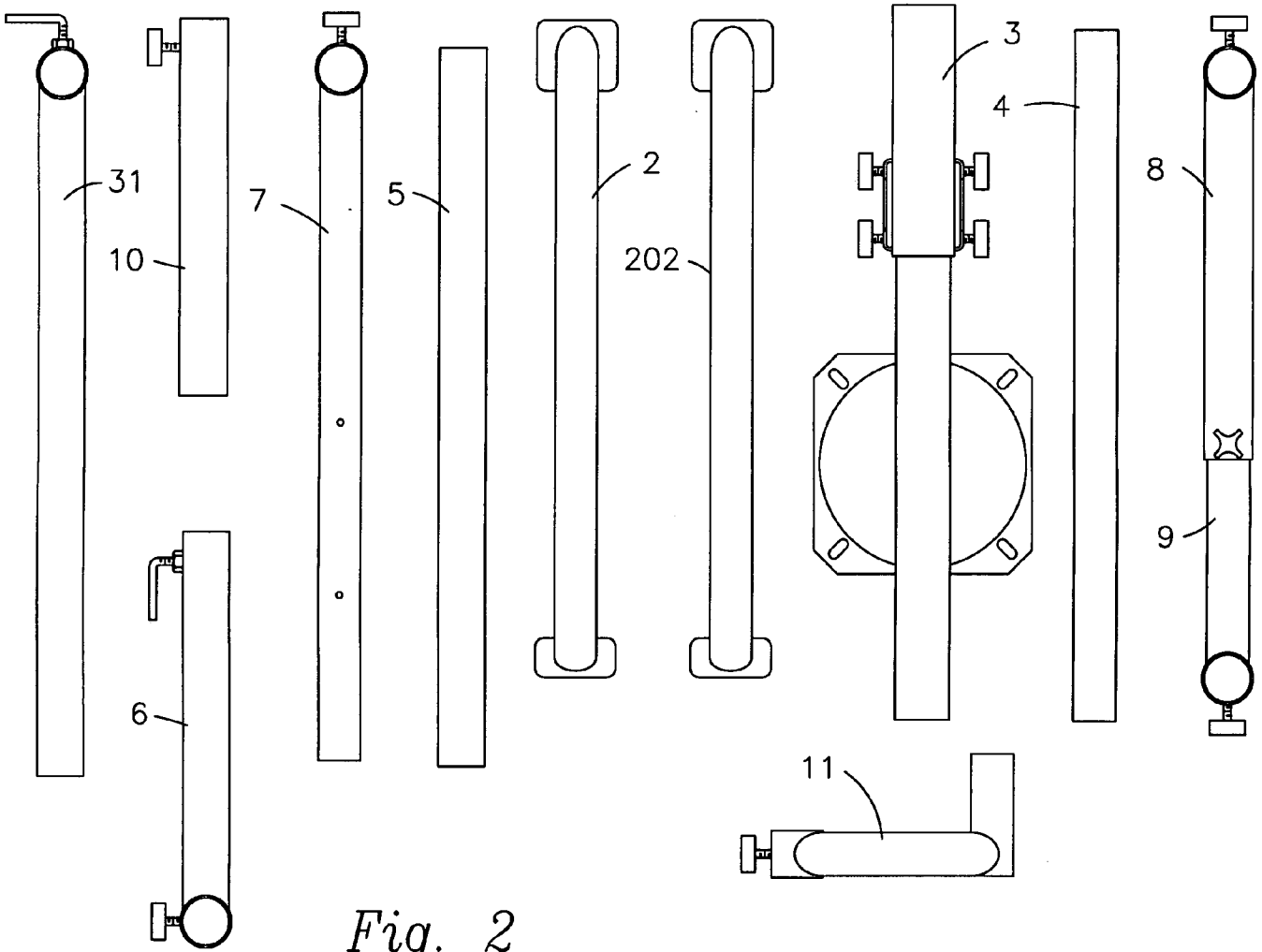
FIG. 2 is a top view of the principal tubular components of the bench of FIG. 1.
Figure 3:
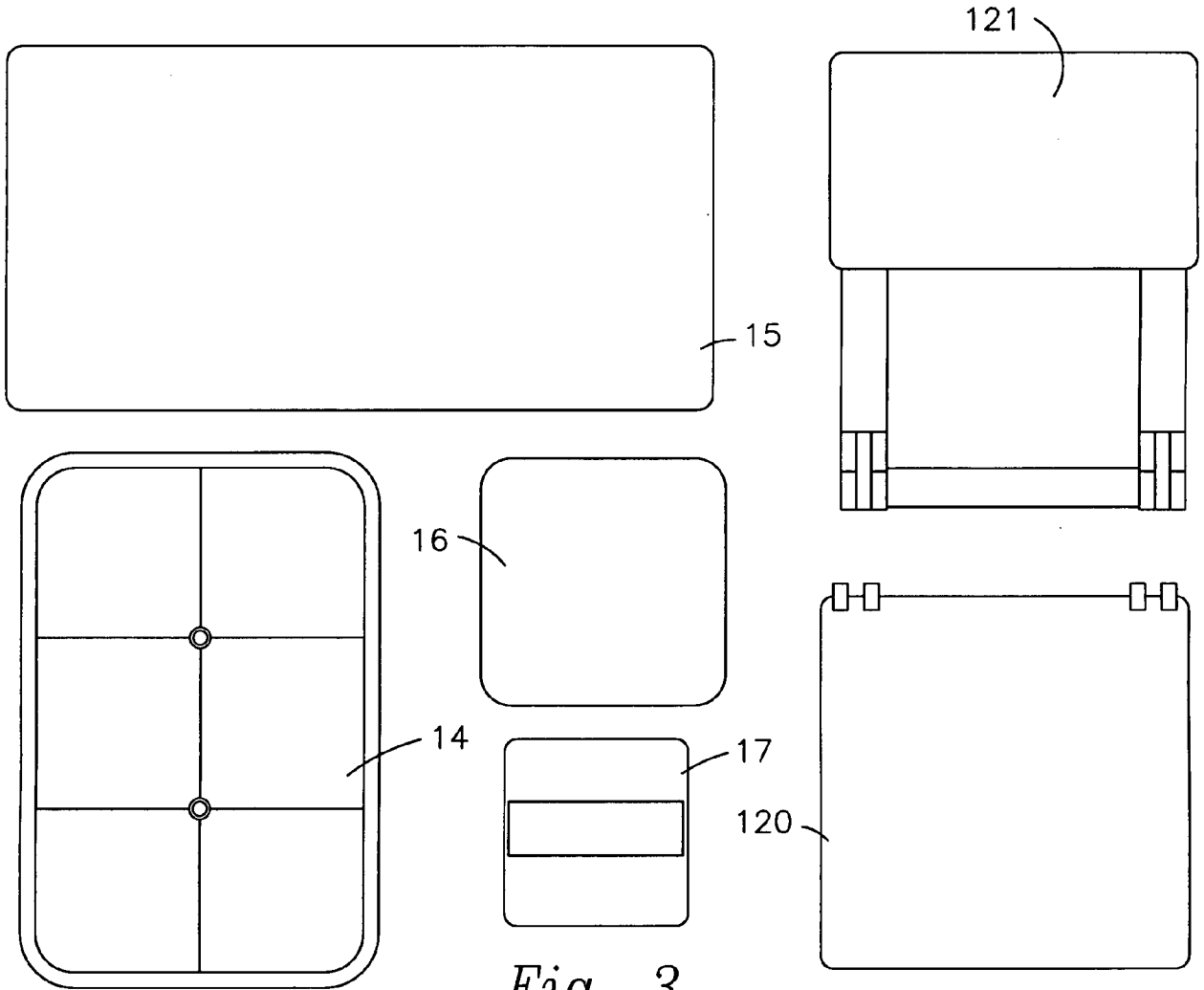
FIG. 3 is a top view of the trays and seat components of the bench of FIG. 1.

FIGS. 2 and 3 depict the principal components disclosed in FIG. 1 in isolation and in addition, inner beam member 31 that connects front leg tube 4 to beam 3 and permits adjustment of the length of beam 3 to front leg tube 4 and seat 12 is disclosed.

Figure 4:
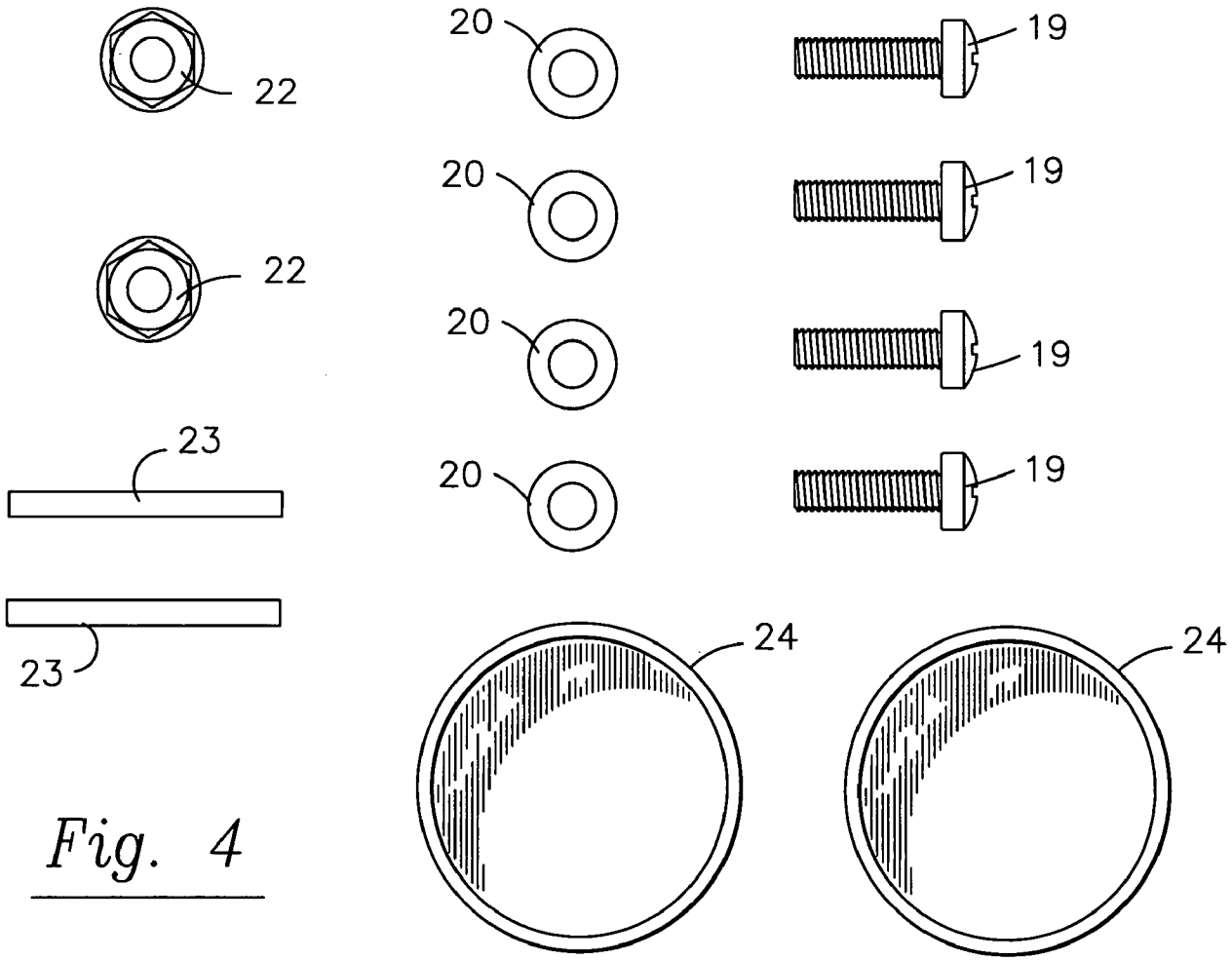
FIG. 4 is a top view of screws, washers, nuts, and end caps that can be advantageously used to assemble the shooting bench of FIG. 1.
Figure 5A:
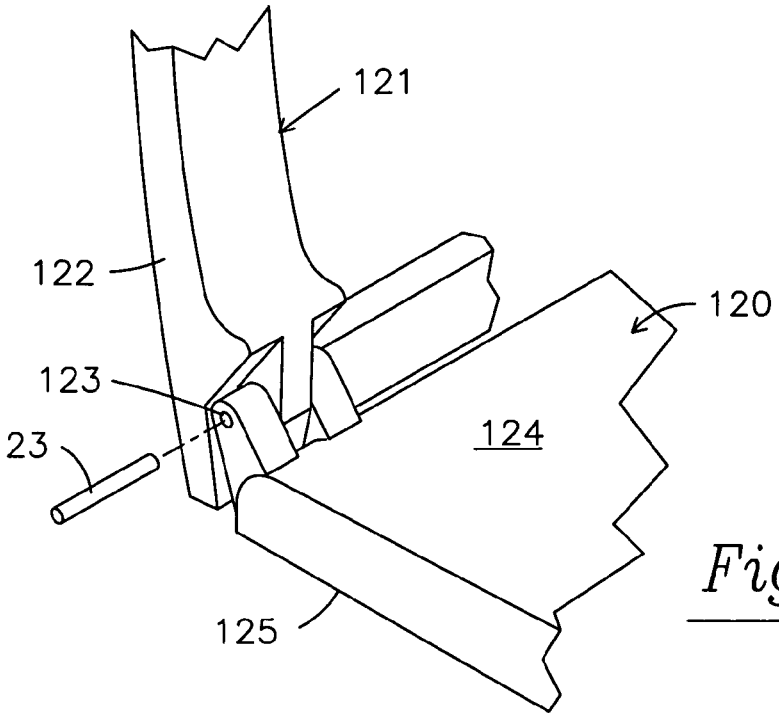
FIGS. 5A–5T are sequential illustrations of the assembly of the shooting bench of FIG. 1.
Figure 5B:
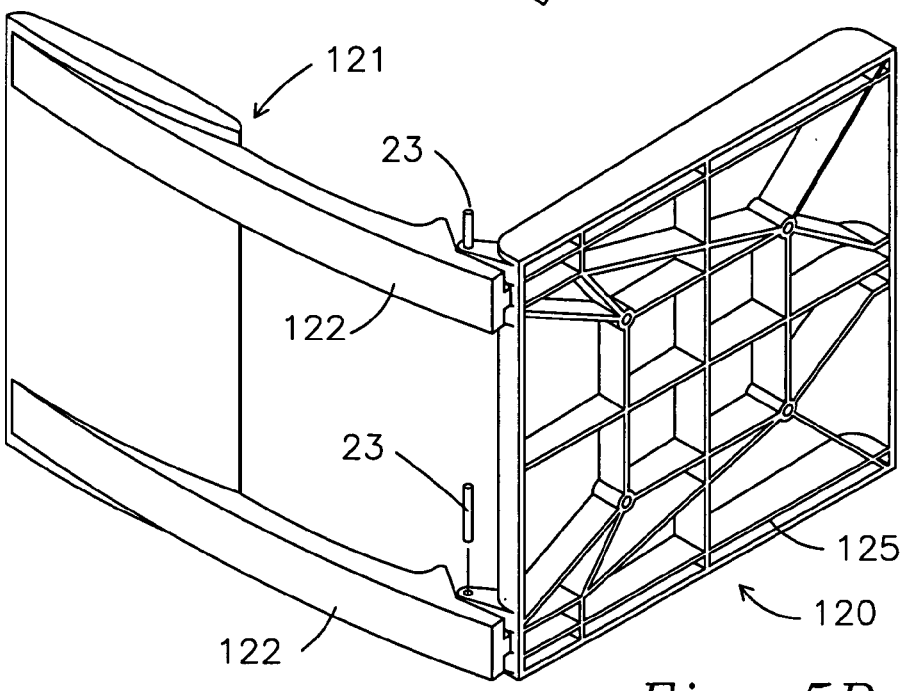
Figure 5C:
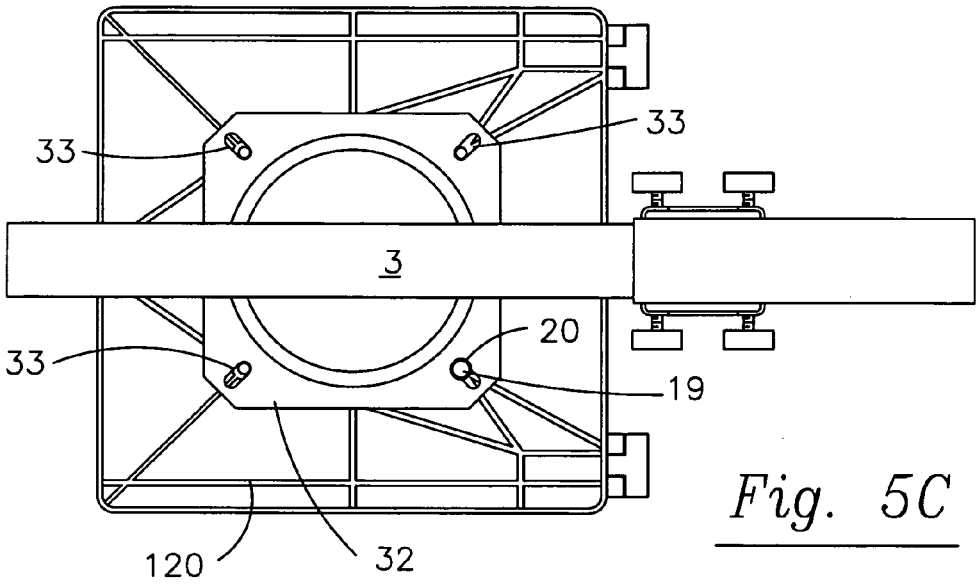

FIG. 4 is a top plan view of end caps 24 utilized on foot member 5 as well as representative screws 19, washers 20, seat pins 23, and nuts 22 that can be utilized to assemble components of the shooting bench As shown in FIGS. 5A and 5B, the seat 12 is advantageously formed from a back portion 121 and a bottom portion 120. The seat back has at its lower end two arms 122 each having an aperture 123 therein. The seat bottom has a top sitting surface 124 and a bottom fastening surface 125. At the rear of the seat bottom 120 are also found apertures which are aligned with apertures 123 in the seat back and pins 23 introduced therein so that the seat back 121 and seat bottom 120 are pivotably connected. The seat bottom 120 and seat back 121 may be advantageously manufactured of injection molded plastic and once pivotably connected, may be collapsed to minimize space consumed by the seat 12.

In the illustrated embodiment, beam 3, which is preferably manufactured of two inch square channel stock in order to interface with a standard trailer hitch, has welded to it a metal mounting plate 32 having several holes 33 through which screws may be passed and received into the bottom surface 125 of seat bottom 120. Preferably, a washer 20 is mounted on screws 19 to spread pressure over mounting plate 32.

Figure 5D:
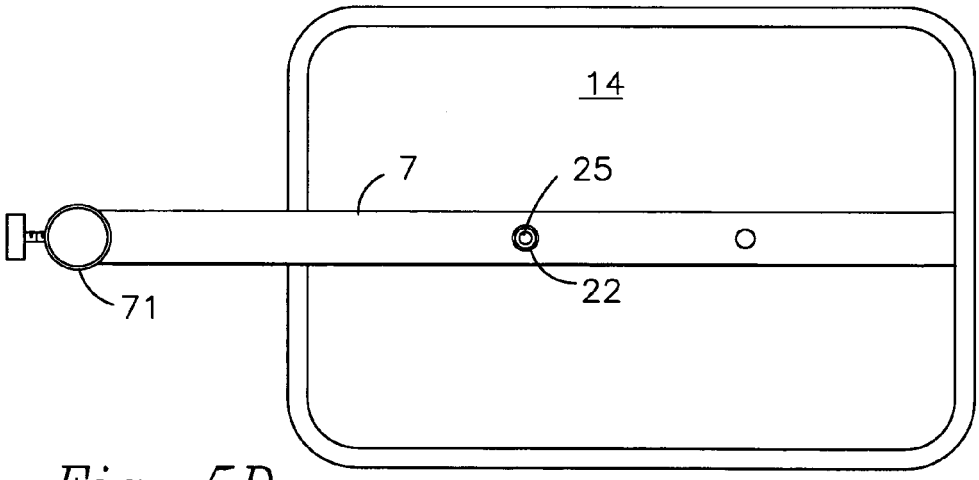
Figure 5E:
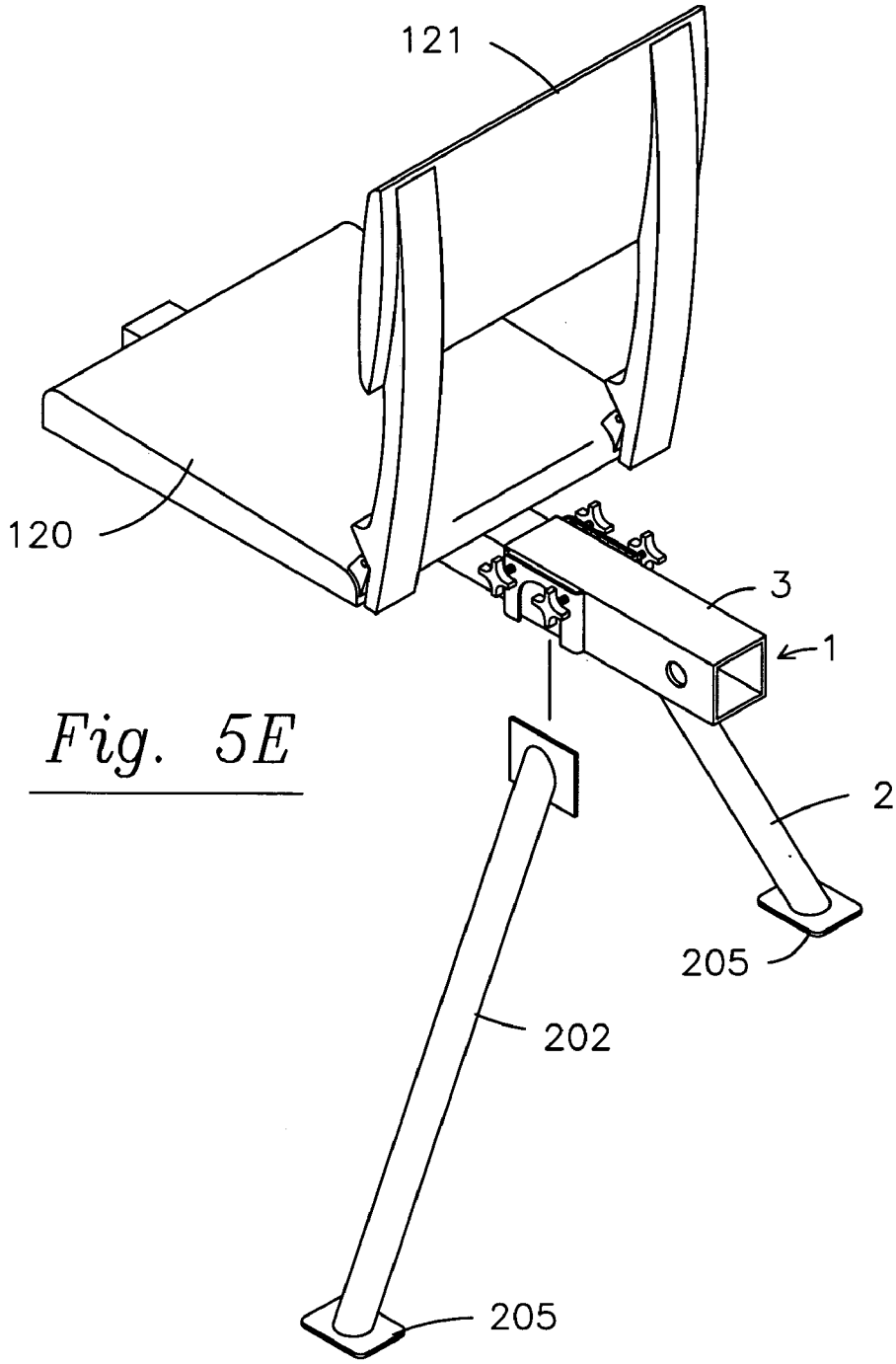
Figure 5G:
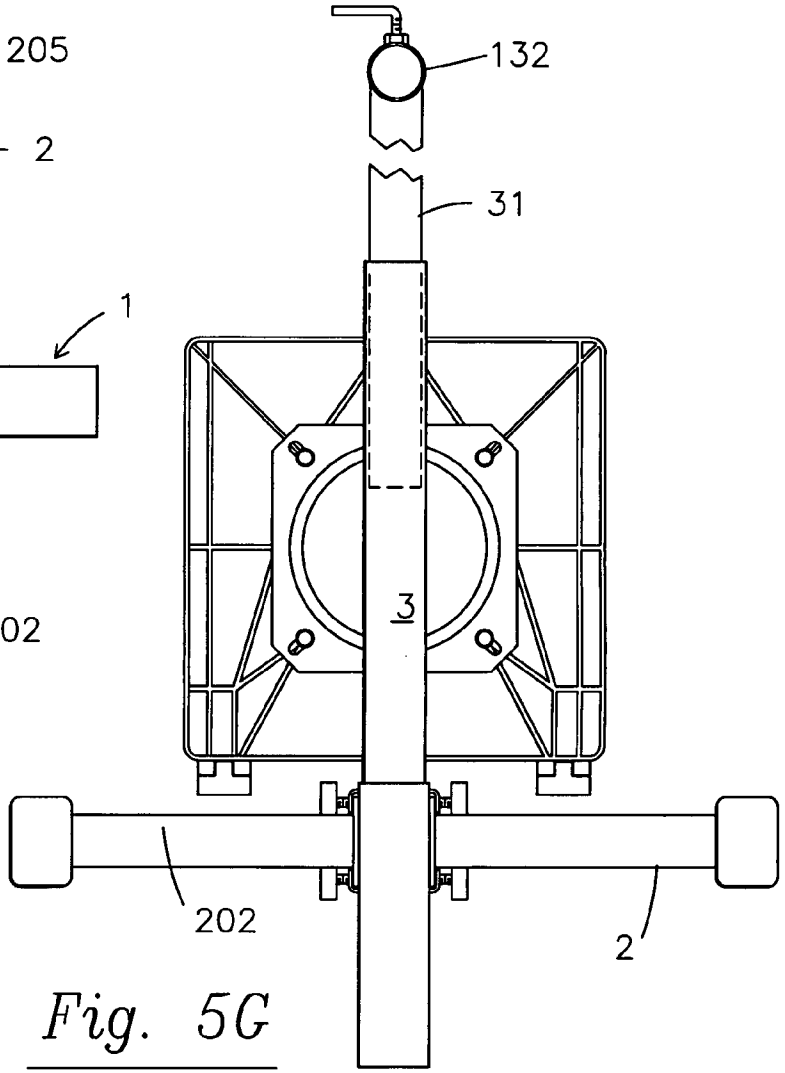
Figure 5F:
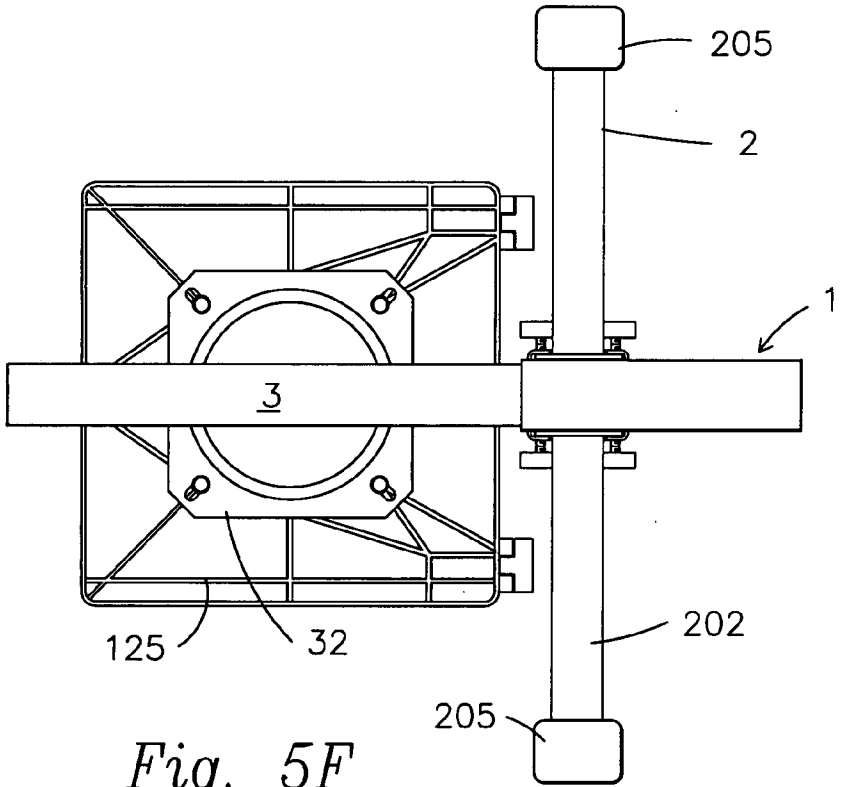
Figure 5I:
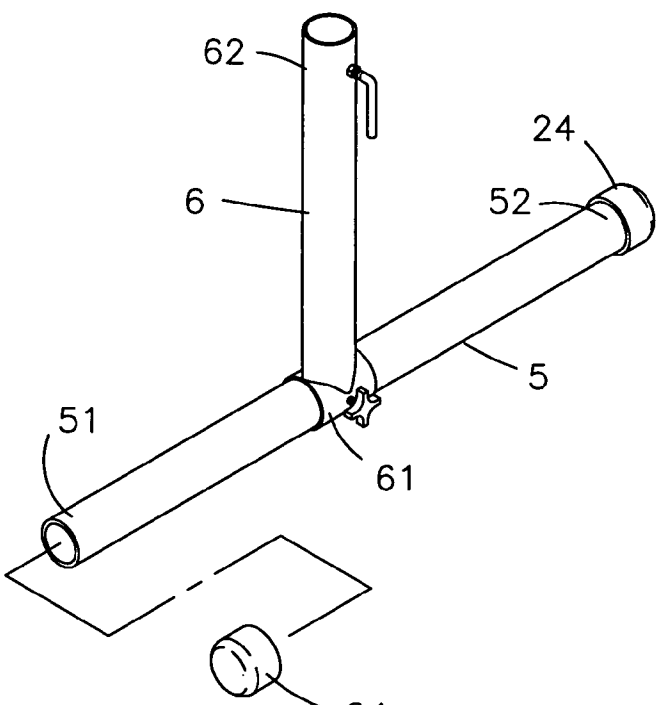
Figure 7:
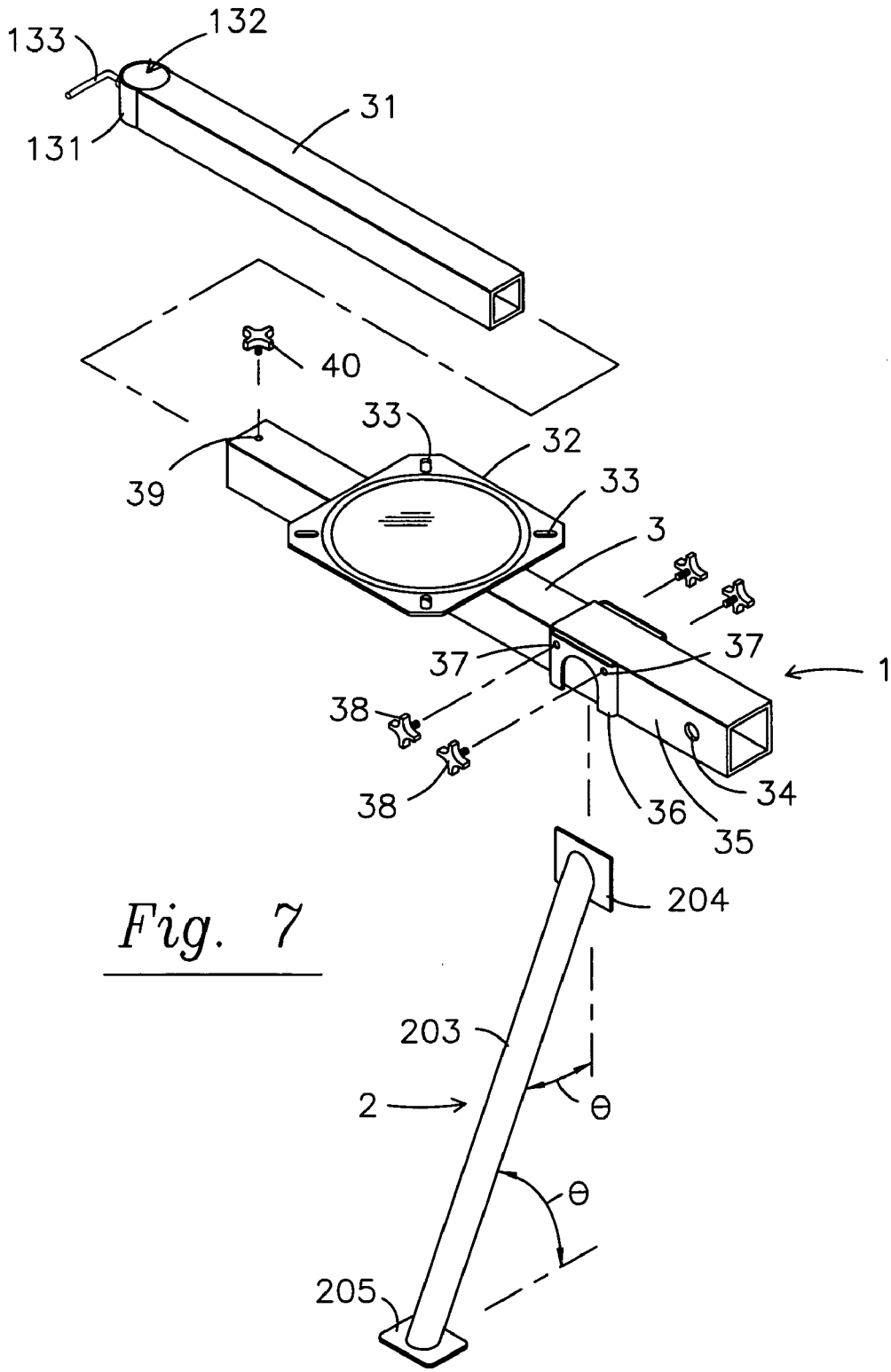
FIG. 7 is an exploded perspective view of the rear leg and inner beam connections to a longitudinal structural member.

The next step in assembling the shooting bench is to attach the rear legs 2, 202 to beam 3 as shown in FIGS. 5E and 5F. Each leg 2, 202 may be substantially identical and as shown in FIG. 7, be comprised of a central support member such as tube 203 and having mounting plate 204 at a first end and base plate 205 at a second end, each plate being attached to tube 203 at an angle θ of about 45°. Mounting plate 204 is received along the vertical side 35 of beam 3 beneath web 36 that has been welded or otherwise attached to beam 3. The edges of mounting plate 204 are received under the edges of web 36. Twist screws 38 may pass through threaded openings 37 in web 36 and securely clamp mounting plate 204 against vertical surface 35 of beam 3. This results in base plate 205 being substantially parallel with the top surface of beam 3 and therefore providing a surface that should be approximately parallel with the ground. Corresponding second leg 202 is similarly mounted on the opposite side of beam 3 to provide two rear legs for the shooting bench.

Figure 5H:
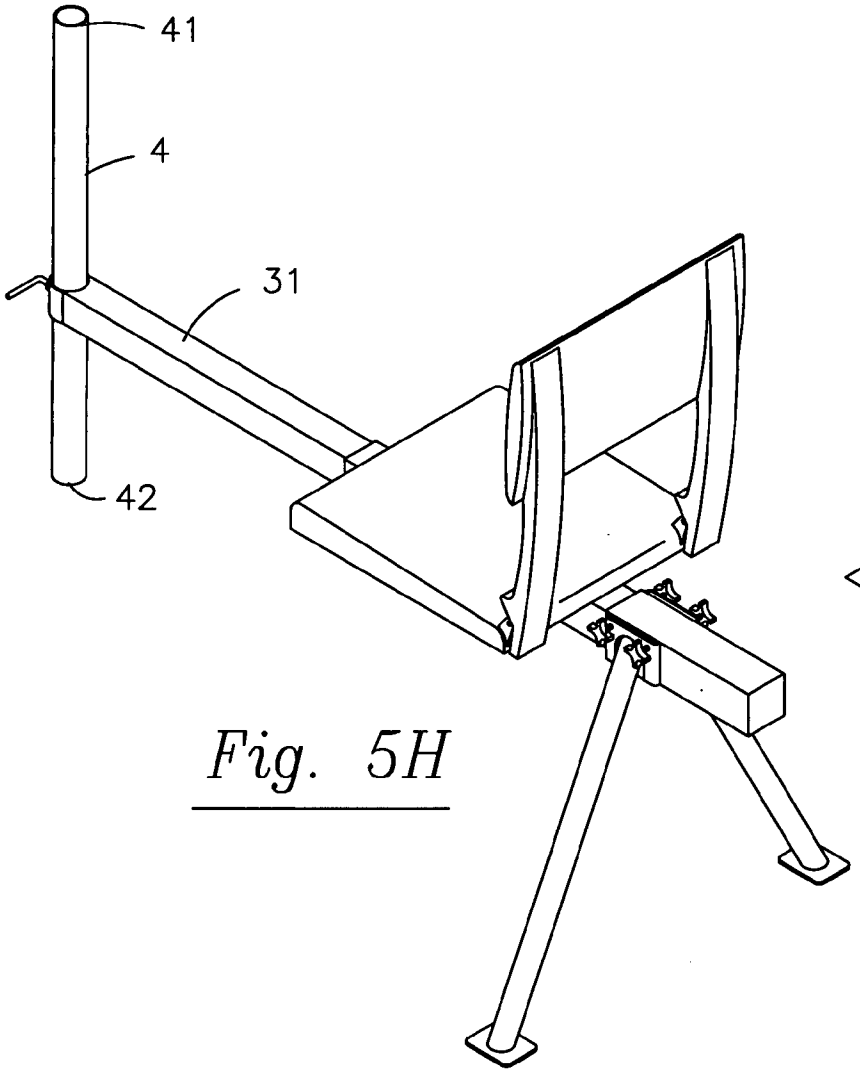

Next as shown in FIG. 5G, inner beam 31 is received within the front of beam 3 and the overall length of the longitudinal support is adjusted by the amount of inner beam 31 so received. As shown in FIG. 7, the position of inner beam 31 fixed by tightening screw 40 in threaded aperture 39 of beam 3 and frictionally engaging inner beam 31. Inner beam 31 then has its proximal end received within beam 3 and its distal end comprises a cylindrical wall 131 which provides vertical tubular opening 132. A threaded aperture in cylindrical wall 131 receives L-screw 133 which may be tightened to frictionally engage any tube passing through tubular opening 132. The top front leg tube 4 is then passed through tubular opening 132 and secured in place by tightening L-screw 133 as shown in FIG. 5H. Then the front foot section is assembled from front leg bottom tube and front foot 5. Front leg bottom member 6 is preferably a longitudinal metal tube having open top end 62 and a lateral cylindrical wall 61 at the lower end forming a tubular opening normal to the longitudinal axis of front leg member 6. The front foot is illustrated as front foot tube 5 received through the tubular opening formed by cylindrical wall 61 at the bottom of front foot member 6 so that a first end 51 of the front foot is disposed on one side of the front leg member and second end 52 of the front foot is disposed approximately equal distant the opposite side of front leg member 6. The terminus of each end 51, 52 is covered with an end cap 24.

Figure 5J:
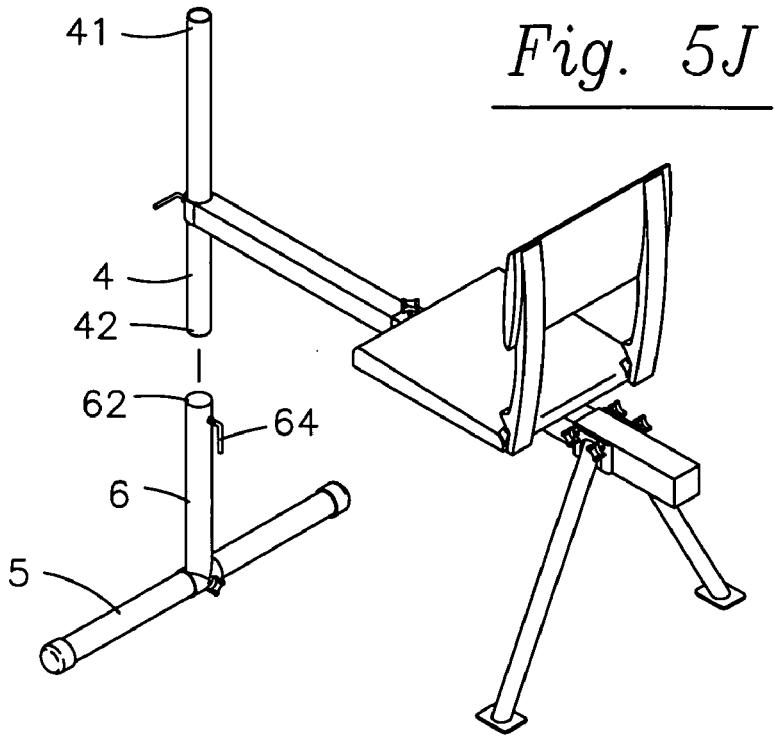
Figure 5K:
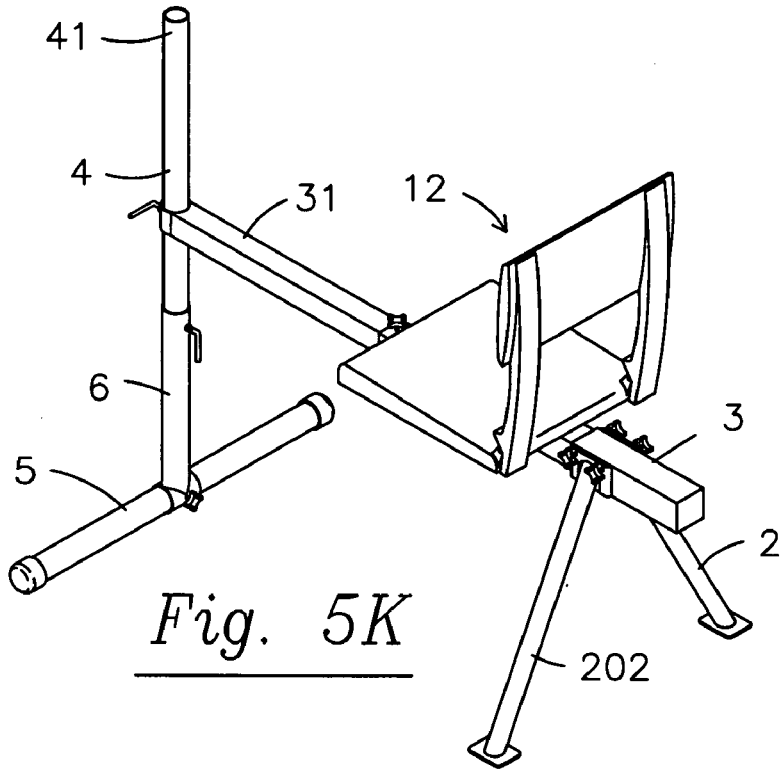

As shown in FIG. 5J, the lower end 42 of top leg member 4 is then received within the upper end 62 of bottom leg member 6. The wall of upper end 62 of bottom leg member 6 has a threaded aperture through which is received a screw fastener 64 that is used to frictionally engage top leg member 4 and thereby provide height adjustment for the front of shooting bench. As shown in FIG. 5K, these components form the basic structure of the shooting bench with seat 12 supported proximate the rear of longitudinal structural members, beams 31, 3, and the front of inner beam 31 being supported by front support structure comprised of leg members 4 and 6 and foot member 5. The rear of beam 3 is supported by legs 2, 202, proximate the rear end, or alternatively may be separated by hitch mount 1. Thus, all that remains is the addition of the tables and trays to complete the assembly.

Figure 5L:
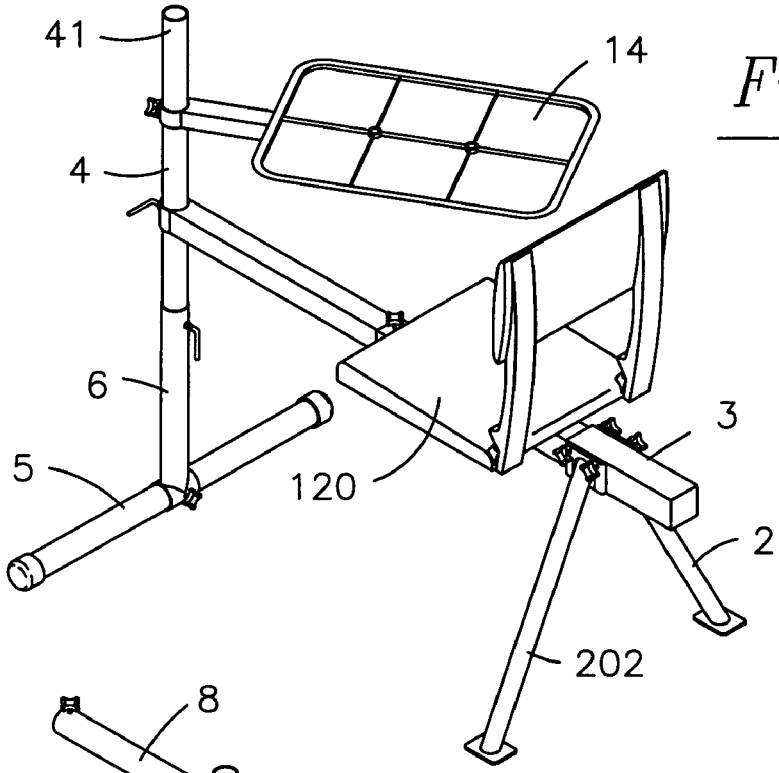
Figure 5M:
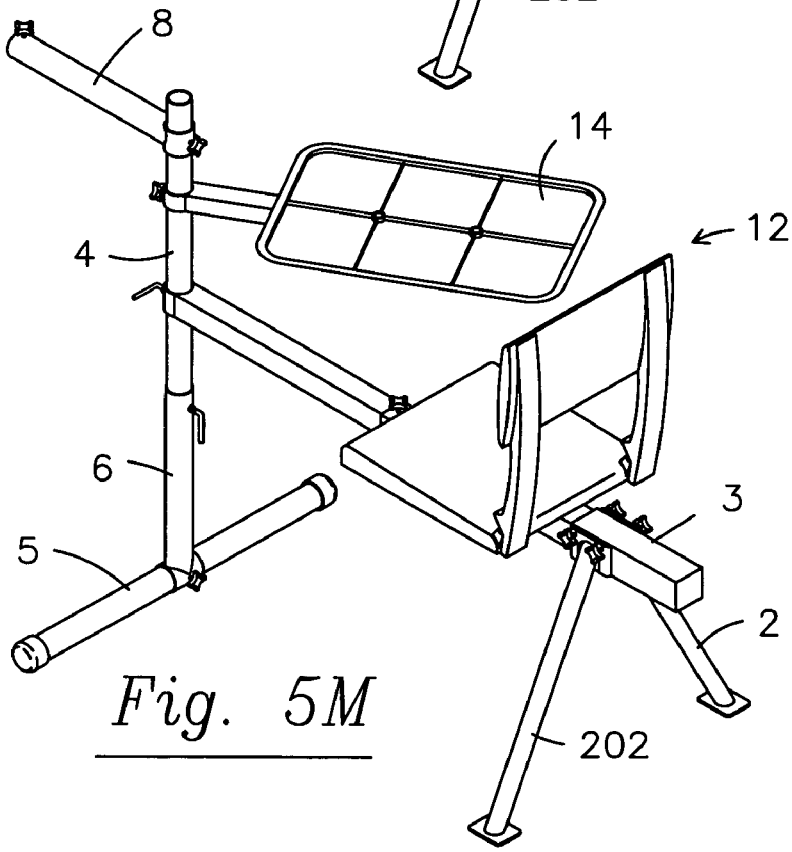
Figures 5N, 50:
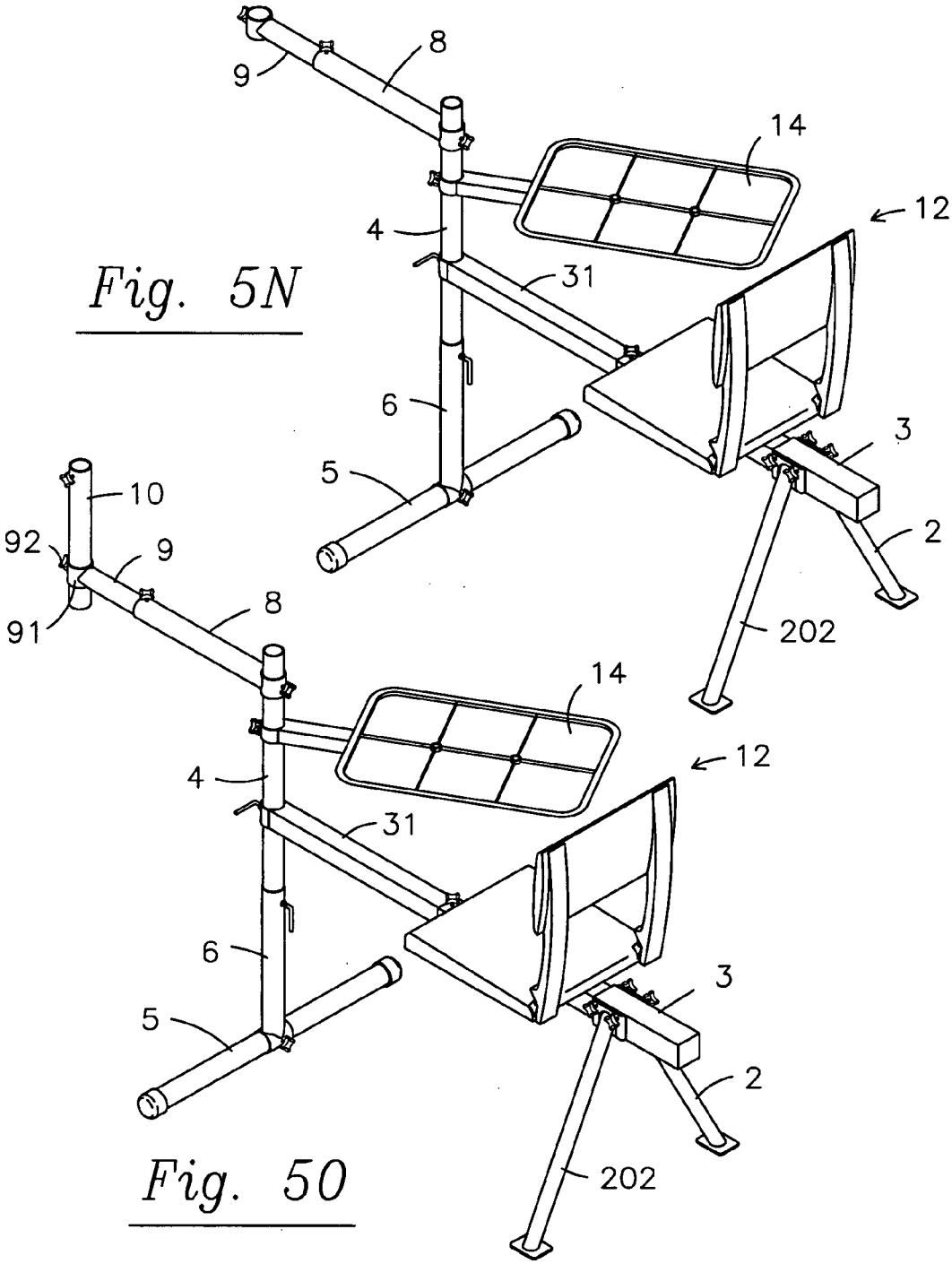
Figure 5P:
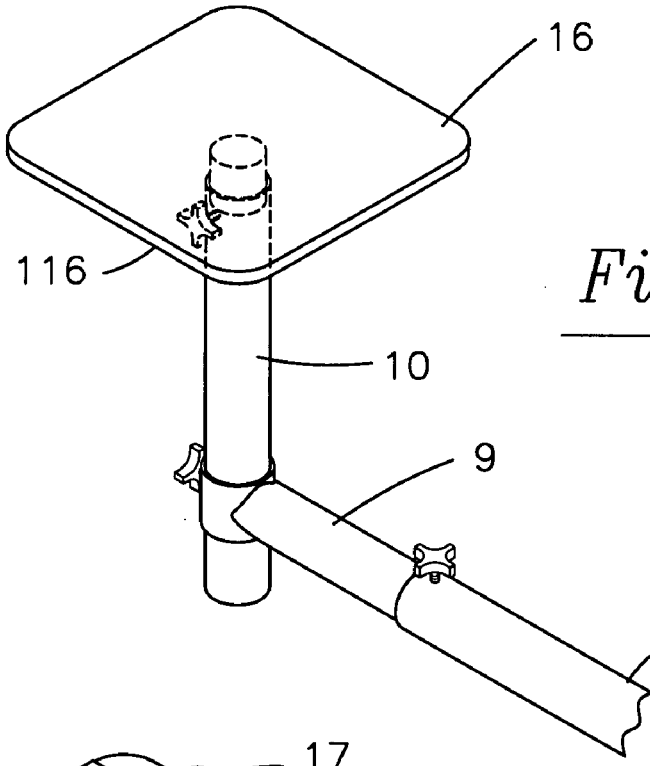
Figure 5Q:
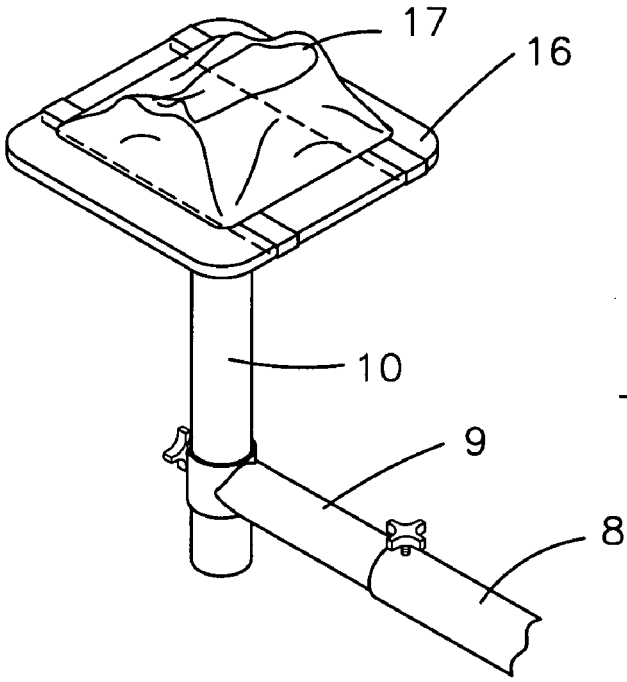
Figure 5R:
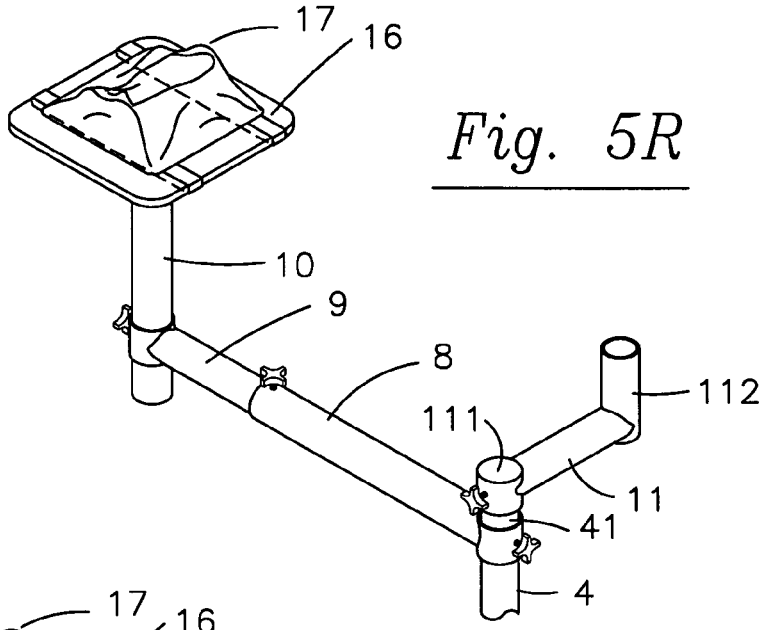
Figure 5S:
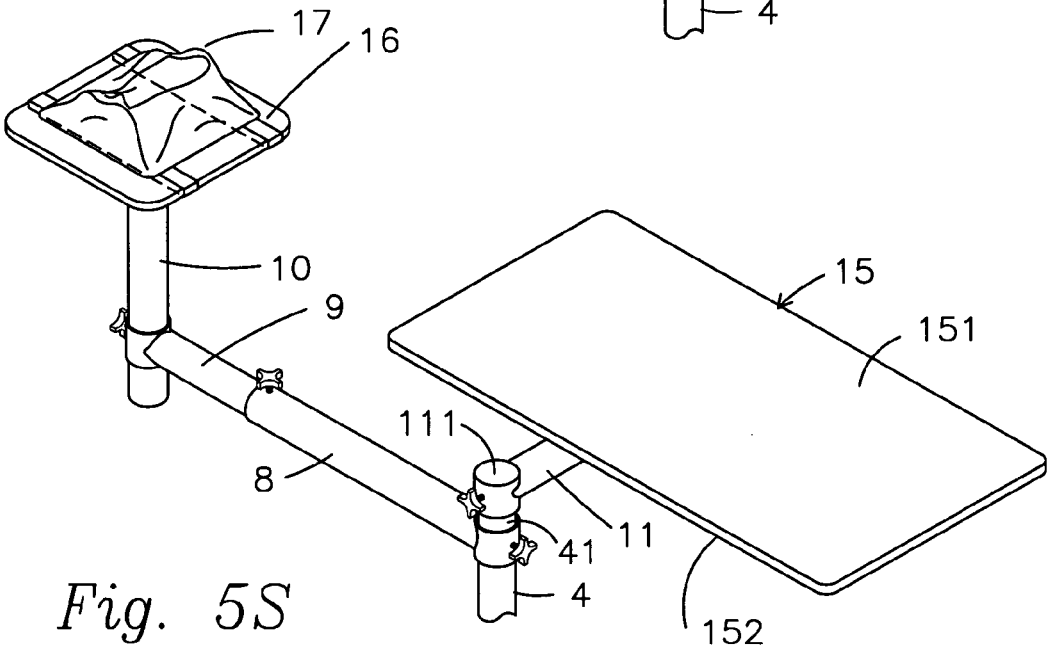

One of these trays is the gear tray 14 with a top surface 141 that may be advantageously divided into sections to facilitate separation of ammunition and tools. Separating ridges may also provide additional support to an injection molded plastic tray. Apertures passing through gear tray 14 may receive fasteners, such as bolts 25 secured with nuts 22, to the gear tray bar 7. Gear tray bar 7 has a proximal end with a cylindrical wall 71 forming a tubular opening that may be received over top front leg tube 4. Cylindrical wall 71 has a threaded aperture to receive a fastener to frictionally engage top front leg tube 4 and to thereby hold the gear tray bar at a desired height on the top front leg tube 4 and proceeding radially outward from such tube at the desired angular orientation. Gear tray bar 7 has openings to receive the aforementioned bolts 25 to secure the gear tray 14 in place. Thus, as shown in FIG. 5D, preferably the gear tray 14 is first mounted to gear tray bar 7 and then the tubular opening of the cylindrical wall 71 is placed over the top 41 of top front leg tube 4 as shown in FIG. 5L. A fastener then passes through cylindrical wall 71 and frictionally engages the top front leg tube 4.

Next the muzzle tray support is assembled from a first horizontal member 8 having a cylindrical wall 81 forming a tubular opening that is received over the top 41 of top leg member 4. Cylindrical wall 81 has an threaded opening 83 that receives a fastening screw to frictionally engage with the wall of front leg member 4 and thereby allow height of first horizontal member 8 to be selected and also to fix the desired angular orientation of the muzzle tray from leg member 4. It is desirable to be able to adjust the horizontal distance of muzzle tray 16 from leg member 4 and to accomplish this, a second horizontal member 9 is utilized. Second horizontal member 9 is interfitting with the first horizontal member and an aperture at the open end of first horizontal member 8 permits the use of a securing screw to engage the wall of the second horizontal member 9 and frictionally secure the relationship of the first and second horizontal members 8, 9 to establish a desired length. The distal end of the second horizontal member 9 ends in cylindrical wall 91 which forms a tubular opening. Cylindrical wall 91 has a threaded aperture to receive another screw like tightening mechanism 92 to engage the wall of vertical member 10 that is received in the tubular opening. This allows adjustment of the height that the top end of vertical member 10 will extend above the horizontal assembly 8, 9. Muzzle table 16 has a bottom surface 161 with a protruding element that may be received in the top end of vertical member 10. The top wall of vertical member 10 has an opening to receive a fastening screw that will frictionally secure the protrusion from the bottom 161 of muzzle table 16. A muzzle mount such as sandbag 17 may then be placed on or secured to the muzzle table 16.

Figure 5T:
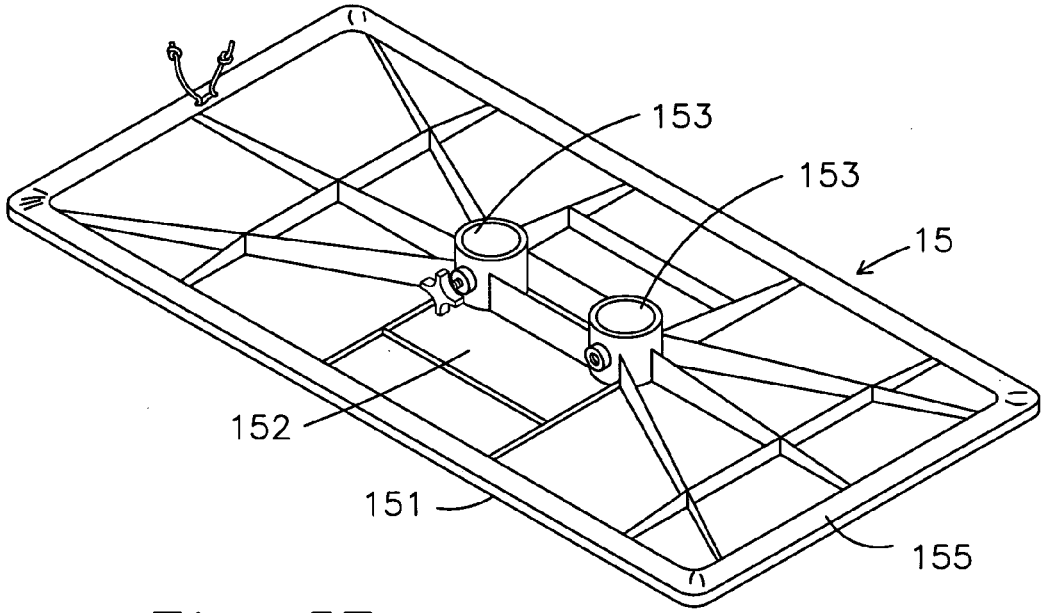

Finally, a swivel connector 11 has a first end ending in cylindrical wall 111 and having a threaded aperture therein. Cylindrical wall 111 forms a tubular opening that is received over the top 41 of upper front leg member 4, and permits the swivel connector to extend from upper front leg member 4 radially in any direction. The tubular opening formed by cylindrical wall 111 may be capped, in which case the height of the swivel connector 11 will not be adjustable other than by adjusting the height of the top end 41 of upper leg member 4. Alternatively, the opening may be uncapped and the swivel connector height adjusted at least somewhat using the frictionally engaging screw to secure the elbow table at the desired height and at the desired angular orientation from upper front leg member 4. The opposite end of swivel connector 11 is an upward facing post 112. The elbow table 15 has a top surface 151 and a bottom surface 152. The illustrated bottom surface 152 has two cylindrical openings 153 adapted to receive the post 112 of the swivel connector 11. The positioning of the elbow table 15 may be modified by selecting the appropriate cylindrical opening 153. Furthermore, cylindrical openings 153 are defined by an outer wall, preferably having a threaded opening in the side which may receive a tightening screw to frictionally engage the post 112 and thereby fix the position of the elbow table. The elbow table 15 may be rotated into desired orientation with respect to its major axis prior to tightening of screws to frictionally engage post 112. As shown in FIG. 5T, prior to placing elbow table 15 on post 112, it may be desirable to attach a canvas or other fabric cover 155 to the table 15 for comfort.

In one advantageous configuration, the elbow table 15, gear tray 14 and muzzle table 16 may be rotated to one side of longitudinal beam 3. An alternative seating mechanism, such as a wheelchair, can then be placed on the opposite side of the longitudinal beam 3, and the elbow table 15, gear tray 14 and muzzle table 16 adjusted for use.

Figure 6:
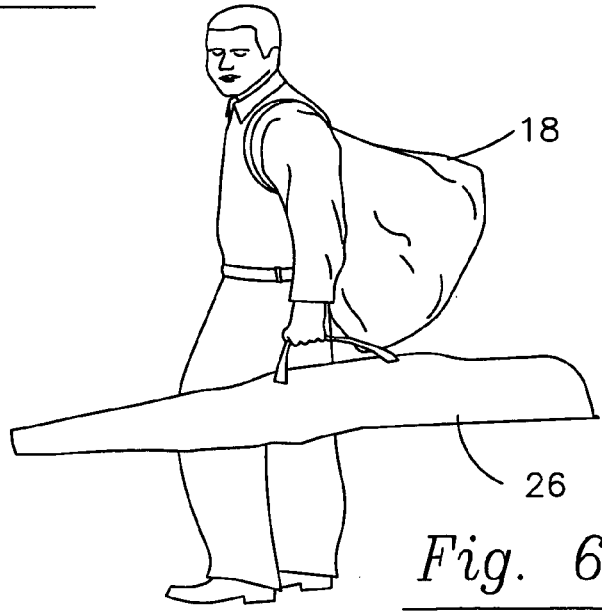
FIG. 6 is an illustration of a marksman carrying a gun in its case and a disassembled shooting bench of the present invention in a pack.

When disassembled, the entire shooting bench assembly fits in a convenient pack 18 and may be easily transported by a marksman together with his gun 26 as reflected in FIG. 6.

While the preferred embodiments of the invention have been described above in detail, it is to be understood that variation and modifications can be made therein without departing from the spirit and scope of the present invention as set forth in the following claims. It is the aim of the appended claims to cover all changes and modifications that may be made without departing from the spirit and scope of the invention.

What is claimed is:

1. A portable adjustable shooting bench comprising a longitudinal structural member having a front end and a rear end;

a seat mounted toward the rear end of the longitudinal structural member;

a rear support structure proximate the rear end of the longitudinal structural member;

a front support structure proximate the front end of the longitudinal structural member;

a pivot axis mount proximate the front end of the longitudinal structural member;

a first support extending radially from the pivot axis mount, said first support being adjustable through an arc of at least about 270°, and supporting a muzzle tray thereon;

a second support extending radially from the pivot axis mount, said second support being adjustable through an arc of at least about 270°, and supporting an elbow tray thereon;

wherein the length of the longitudinal structural member is adjustable from a shorter length to a longer length, thereby correspondingly increasing the distance between the seat and the pivot axis mount.

2. The portable adjustable shooting bench of claim 1 further comprising a third support extending radially from the pivot axis mount, said third support being adjustable through an arc of at least about 270°, and supporting a gear tray thereon.

3. The portable adjustable shooting bench of claim 1 wherein the rear support structure comprises a trailer hitch mount at the rear end of the longitudinal structural member.

4. The portable adjustable shooting bench of claim 1 wherein the length of the muzzle support member is adjustable from a shorter length to a longer length.

5. The portable adjustable shooting bench of claim 1 wherein the height of the muzzle tray is adjustable.

6. The portable adjustable shooting bench of claim 1 wherein the front support structure is adjustable to vary the height of the front end of the longitudinal structural member.

7. The portable adjustable shooting bench of claim 1 wherein the elbow tray has a fabric cover.

8. The portable adjustable shooting bench of claim 1 wherein the seat has an upstanding back portion pivotably attached to a bottom portion.

9. A kit for the assembly of an adjustable shooting bench comprising the following parts:

a length adjustable longitudinal structural member having a rear end with a mounting plate proximate thereto, and an opposite front end;

a foldable seat having a bottom adapted for securing to the mounting plate;

a rear support assembly mountable proximate the rear end of the longitudinal structural member;

a cylindrical tube attachable vertically near the front end of the longitudinal structural member;

a first support extending longitudinally from a cylindrical wall at a first end to a second end;

a second support extending longitudinally from a cylindrical wall at a first end to a second end;

a muzzle tray attachable to the second end of the first support and an elbow tray attachable to the second end of the second support.

10. The kit of claim 9 further comprising a third support extending longitudinally from a cylindrical wall at a first end to a second end and a gear table attachable to the second end of the third support.

11. The kit of claim 9 wherein the first support has a cylindrical wall at the second end, and the kit further comprises a second cylindrical tube that interfits with the cylindrical wall at the second end.

12. The kit of claim 9 wherein the disassembled parts are designed to be contained in a pack for transport by a human.

13. A method of assembling an adjustable shooting bench kit which includes a length adjustable longitudinal structural member with a front end and a rear end; a foldable seat; a rear support assembly; a front support assembly; a pivot axis mount; a first support extending between a first end to a second end; a longitudinal second support extending from a first end to a second end; a muzzle tray; and an elbow tray comprising the steps of:

(a) positioning the rear support assembly proximate the rear end of the length adjustable longitudinal structural member;

(b) attaching the front support to the front end of the length adjustable longitudinal structural member;

(c) attaching the foldable seat proximate the rear end of the length adjustable longitudinal structural member;

(d) attaching the pivot axis mount proximate the front end of the length adjustable longitudinal structural member;

(e) adjusting the length of the longitudinal structural member and thereby adjusting the proximity of the seat to the pivot axis mount;

(f)(i) attaching a first end of the first support to the pivot axis mount;

(ii) attaching the muzzle tray to the second end of the first support;

(iii) rotating the muzzle tray radially about the pivot axis mount to a desired orientation and securing the first support in the resulting position;

(g)(i) attaching a first end of the second support to the pivot axis mount;

(ii) attaching the elbow tray to the second end of the second support; and (iii) rotating the elbow tray radially about the pivot axis mount to a desired orientation and securing the second support in the resulting position.

14. The method of assembling an adjustable shooting bench kit of claim 13 wherein the rear support assembly has a trailer hitch mount on the rear end of the length adjustable longitudinal structural member and a trailer hitch on a vehicle, and step (a) comprises mounting the trailer hitch mount to the trailer hitch.

15. The method of assembling an adjustable shooting bench kit of claim 13 wherein the rear support assembly and the front support assembly each comprise a load bearing leg.

16. The method of assembling an adjustable shooting bench kit of claim 13 wherein the kit includes a longitudinal third support having a first end and second end, and a gear tray, further comprising the steps of:

(h)(i) attaching a first end of the second end of the third support to the pivot axis mount;

(ii) attaching the gear tray to the third support; and (iii) rotating the gear tray radially about the pivot axis mount to a desired orientation and securing the third support in the resulting position.

17. The method of assembling an adjustable shooting bench of claim 13 wherein the second end of the first support comprises a cylindrical wall, and utilizing a vertical tube member with a lower end and the opposite second end to attach the muzzle tray, further comprising the steps of:

(f)(iv) attaching the muzzle tray to the second end of the vertical tube;

(v) passing the lower end of the vertical tube member through the cylindrical wall; and (vi) adjusting the muzzle tray to a desired height and securing the vertical tube member relative to the cylindrical wall in the resulting position.

18. The method of assembling an adjustable shooting bench kit of claim 13 further comprising the step of:

(f)(iv) adjusting the length of the first support member.

19. The method of assembling an adjustable shooting bench kit of claim 13 further comprising the step of:

(h) setting the height of the front end of the longitudinal structural member as desired and adjusting the attachment of the front support to the resulting position.

* * * * *